United States Patent [19]

Vuorento

[11] 4,301,923

[45] Nov. 24, 1981

[54] DISPOSABLE PORTION PACKAGE

[76] Inventor: Lasse T. J. Vuorento, Aleksanterinkatu 26 A, SF-33100 Tampere 10, Finland

[21] Appl. No.: 70,363

[22] Filed: Aug. 28, 1979

[30] Foreign Application Priority Data

Aug. 29, 1978 [FI] Finland ..... 782631
Feb. 27, 1979 [FI] Finland ..... 790644

[51] Int. Cl.[3] ..... B65D 83/14

[52] U.S. Cl. ..... 206/484; 206/631; 222/491; 222/107

[58] Field of Search ..... 206/484, 631, 602, 628; 222/491, 107, 494

[56] References Cited

U.S. PATENT DOCUMENTS 2,334,600 11/1943 Boysen ..... 206/628
2,984,346 5/1961 Holley ..... 206/602
3,118,573 1/1964 Johnson ..... 222/491
3,182,728 5/1965 Zabriskie ..... 222/107
3,251,463 5/1966 Bodet ..... 206/484
3,630,346 12/1971 Burnside ..... 206/484
4,196,809 4/1980 Tonrey ..... 206/484

*Primary Examiner*—William T. Dixson, Jr.
*Attorney, Agent, or Firm*—Jordan and Hamburg

[57] ABSTRACT

A disposable portion package for liquids, creams, powders or the like, the package mainly comprising a casing made of a flexible film, which tightly encloses the packaged substance and also a certain amount of air or some other gas, the package having been provided with at least one conduit or the like, which has been arranged to open by means of pressure produced inside the package, for example by pressing the package between the fingers in order to obtain the contents for use, preferably as a finely-divided spray, the package comprising at least two wall parts sealed to each other, the conduit being formed in some layer in the seam connecting the wall parts by weakening the seam in the conduit area, in which case, when package is pressed, the area of the conduit opens to make the substance available for use.

16 Claims, 9 Drawing Figures

DISPOSABLE PORTION PACKAGE

BACKGROUND OF THE INVENTION

The present invention relates to a disposable portion package, especially for liquids, pastes, creams and the like, the package comprising a casing which is primarily made of a flexible plastic film or the like and tightly encloses the packaged material and a conduit in conjunction with the casing, the conduit having been arranged to open under pressure produced inside the package by, for example, pressing the package between the fingers in order to make the contents available for use.

Packages of this type for pastes and creams are previously known. Norwegian Pat. No. 86,391 discloses a kind of small portion capsule or tube which contains a single portion of a cosmetic substance or the like, which can be obtained from the package by pressing. A kind of outlet conduit has been made in the package and the conduit is closed with a plug made of a material weaker than the package itself, so that it is broken by the pressure produced by pressing, thereby opening the outlet. However, this known package has a disadvantage in that it is difficult and expensive to manufacture, and therefore it has not gained great popularity. Even the shape of the package is somewhat impractical.

In the invention according to U.S. Pat. No. 3,595,466 the opening system of the package is based on the fact that the package contains, as an integral part, a kind of stiffening member positioned in the area of the opening point of the package, and in this case, when the package is opened, it is pressed in the direction of this member, which is a ring or a plate. Pressing produces tension in the direction of the plane of this member, and the package opens at the weakened point in the package film.

It should be noted that in this package, when it is being opened and pressed at the opening point, it is not possible and not the intention to develop a pressure which causes the contents to discharge suddenly as a spray, but the contents are discharged primarily as a flow.

The applicant's previous Finnish patent application, No. 753728, discloses a small bubble package made of plastic; this package is also of the type mentioned earlier and is characterized in that a weakened point has been made in the wall of the package in order to have each package open at the same point and that the said weakened point is appropriately marked, by, for example, an arrow or the like, in which case the direction of the flow of material can be determined in advance.

However, practice has shown that different substances to be packed also require different types of thinning in the wall. Such thinning is technically difficult to control and implement. In addition, thinning has proven to be impossible when using plastic film types (e.g. laminated plastic films) which are better impermeable to liquids and gases than conventional plastic films. If it is desired, for example, to pack cosmetic liquids in bubble packages of the type in question it is necessary to obtain packages in which the liquids keep unevaporated or unchanged over even long periods in order to make storage before selling possible. Such packages are possible if, for example, the said laminated plastic films are used.

The object of the present invention is to eliminate the above disadvantages and to provide a new, improved package of the type defined in the preamble and that the new package is of the type in which the contents are always discharged in the same manner from a specific point in a predetermined direction. Another object is to provide a package the manufacture and filling of which are simpler than previously and can both also be effectively automated. A further object is to provide a package with a shape advantageous in terms of both marketing and use.

SUMMARY OF THE INVENTION

According to the present invention, the package is made of two or more flexible films, e.g. plastic films, tightly attached to each other, one or more of them being smooth and one having been provided with two or more rows of depressions at a specific distance from each other, and that a closed conduit has been arranged to lead from each depression, the conduit converging like, for example, a wedge between the said walls, the conduit having been fitted to open under pressure and ending in a weakened tearing point, perforation or the like between the depressions, in which case the individual packages can be detached from each other.

In addition to achieving the above abjects, the present invention provides the advantage that the said discharge conduits and weakened points are produced in the same work stage as is the sealing of the packages.

DESCRIPTION OF THE PREFERRED EMBODIMENTS

Figure 1:
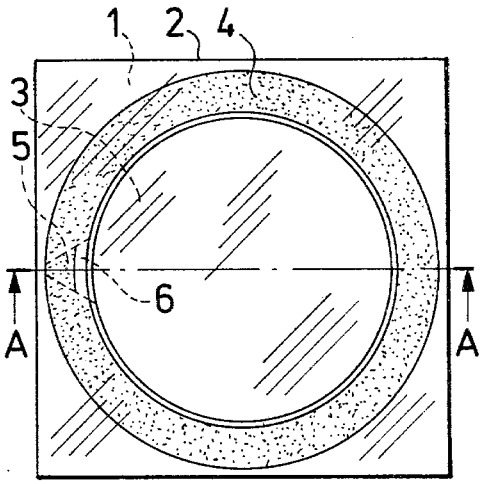
FIG. 1 depicts a plan view of one package according to the invention, on an enlarged scale.
Figure 3:
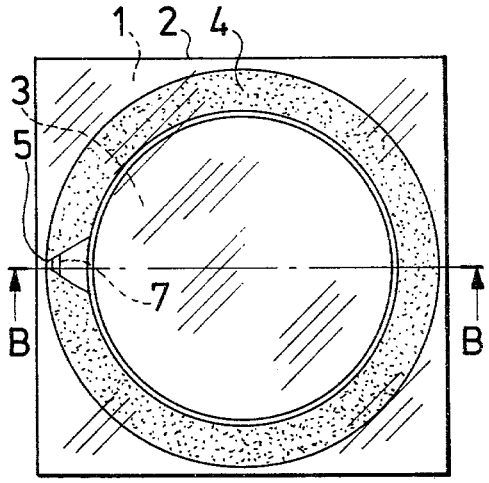
FIG. 3 depicts a plan view of another package according to the invention.
Figure 2:
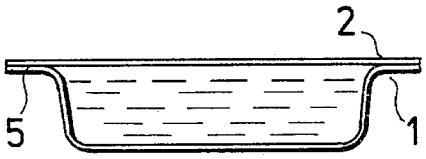
FIG. 2 depicts the package in section A—A of FIG. 1.
Figure 4:
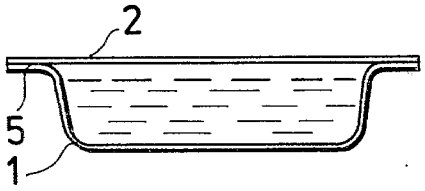
FIG. 4 depicts section B—B of FIG. 3.

According to one preferred embodiment of the invention, the package is made upo of two plastic-film parts, bottom part 1 and top part 2. The bottom part 1 has a depression 3, which forms the packaging space; the depression can be round, as it is in this example case. The top part 2 is of smooth film. The liquid or similar material to be packed is placed in the depression of the bottom part in a suitable way, known per se. The top part 2 is attached in its place on the bottom part by sealing it at the edges of the depression. It should be noted that the substance to be packed must not fill the space entirely, but there has to be also a small amount of air or, for example, some inert gas. The air or gas space has a certain significance when the material discharges as the package is pressed. It causes the substance to disperse into a finely-divided mist when it is compressed and then re-expands as the package contents are discharged.

The top part 2 is attached to the bottom part 1 by heat sealing 4, known per se, the seam extending around the depression. According to the invention, during this heat sealing, a discharge conduit 5 extending radially in relation to the packaging depression across the seam is formed in conjunction with the heat sealing using the same heat sealing tool; according to the invention, however, the conduit 5 is at least partly closed and intended to open when the package is pressed, in which case pressure is produced inside the package, opening the said conduit. The conduit 5 can be obtained by, for example, providing the sealing tool with a suitably low depression at the position of the conduit, corresponding to the shape of the conduit, and therefore the seal is not pressed and does not adhere at the conduit as firmly as in the rest of the package, but remains weaker. Consequently, when the package is pressed, the pressure produced in it opens the conduit and the material squirts out in the desired way, as a misty spray. The conduit 5 can, furthermore, be made so that it is partly open at point 6 over the part delimited by the inside of the package, in which case the pressure generated in the package fan have a better effect inside the conduit, thus opening the conduit when the package is used.

The shape of the conduit 5 is preferably one which converges like a wedge outwards from the edge of the packaging space so that the discharge is in the form of a finely-divided spray or mist. The angle of convergence of the conduit and the size of the discharge opening are selected and made according to the substance to be packed, also taking into account the material of the package itself. The suitable values are determined mainly experimentally.

The conduit can also be made in such a manner that during the sealing it is left open, but simultaneously a thin transverse seam 7 is made in it, in which case this seam can be produced by weaker than normal or stronger than normal pressing. In the former case this area in the sealing tool is gouged somewhat deeper than the rest of the sealing part, and the seam thereby produced is somewhat less pressed and consequently easier to detach than the rest of the seam. In the second case the area corresponding to the seam 7 in the sealing tool is made more protruberant so that, during sealing, it presses the respective area to a somewhat greater depth, thereby weakening the wall of the package in this area. Consequently, when the package is pressed the conduit opens as the wall breaks along the seam 7.

According to a third embodiment of the invention, illustrated in FIGS. 6–9, the package preferably comprises even other material and film layers in addition to the two film layers 1 and 2 mentioned above. Usually a thin aluminum foil 9 is used as a kind of stiffening member for a package series, and it is attached to the top film 2 of the package via a thin polyethene film 10. It has been observed that it is advantageous to place the said polyethene film 10 between the aluminum foil 9 and, for example, a Surlyn film 2, since this produces a better adherence to the aluminum foil. The polyethene film can, however, be replaced by some suitable coating layer on the aluminum foil, in which case the said Surlyn film adheres to this coating. On the other side of the aluminum foil there can also be a thin paper band 11. Furthermore, on top of this there can be a polyethene film 12, which supports and reinforces the paper band.

According to the invention, the ratio between the thicknesses of the above-mentioned films is of great importance in respect to the functioning of the package. The thickness of the film 1, which constitutes the bottom part of the package, should preferably be approx. 100 to 250 μm and the thickness of the film 2, which constitutes the top part, respectively approx. 1 to 35 μm, i.e. 1/5 to 1/100 of the former. Furthermore, the intermediate polyethene film 10, if one is used, should be very thin, approx. 5 to 20 μm, in order for the package to function in the desired manner.

Figure 9:
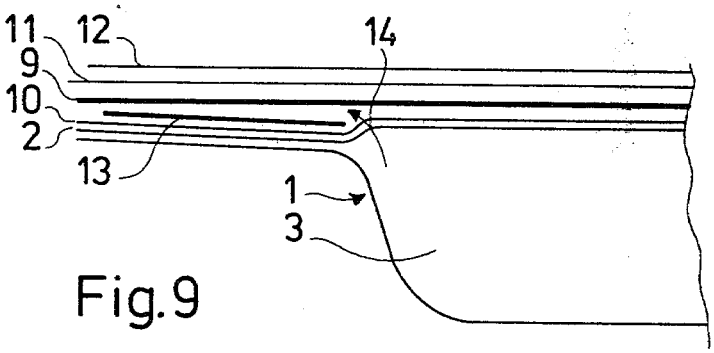
FIG. 9 depicts a partial section of the opening stage of the discharge conduit of a package according to FIG. 6, when the package is being pressed.

In this case, according to the invention it is furthermore, essential that the discharge conduit of the package is made so that a pattern 13 of dye or a substance serving as dye has been formed or caused to form by a technique known per se on the surface of the said aluminum foil in the area intended for the discharge conduit; this pattern has the shape of the said conduit and resembles, for example, an arrow or a triangle, and is of a substance which forms with the aluminum foil and/or the filme 2 of the package top part coming over it or with the polyethene film 10 a bond which is weaker than the bond between the films and the rest of the aluminum foil. This produces the technical effect that, when the package is pressed in order to open and to spray out the substance inside it, those parts of the films which are in the area of the said color mark separate from the aluminum foil, whereby a discharge conduit is formed and the bottom films of the package bulge at this point towards the inside of the conduit and finally break, since they are very thin, as described above. Thereby the substance in the package discharges precisely in the desired direction through the conduit. FIG. 9 depicts the initial stage of the discharge; when the package is being pressed, those parts of the films 2 and 10 which are at the color mark 13 rise and detach from the aluminum foil which is at the bottom, and at this time the part 14 of the films 2 and 10 somewhat further back bulges towardss the conduit being formed and finally breaks, whereby the substance in the package discharges.

The arrow-shaped or triagular color mark can be replaced by some other printed pattern in order to produce a conduit according to the invention. It can be, for example, a straight line passing through the seam 4, thereby effecting the weakening in the seam 4 to form a conduit, as set forth in the invention.

The package according to the invention is implemented most advantageously by providing the said aluminum foil 9 first with the said printed color marks 13, and then a primer lacquer is applied. Thereafter the foil is laminated with the said polyethene film 10 and a Surlyn film 2 on one side with a paper band 11 and a possible polyethene film 12 on the other side. Thereafter the laminated band thus obtained is used as top material for packages according to the invention, in which case it is conveyed in the packaging machine at precisely determined conveying speeds, and it is controlled in such a manner that the said printed conduit marks always coincide with the seam of a package. This can be effected by techniques known per se.

The individual and laminated plastic films can of course be replaced by combined films in which two or more plastic films have been extruded simultaneously and attached to each other during the extrusion.

Figure 5:
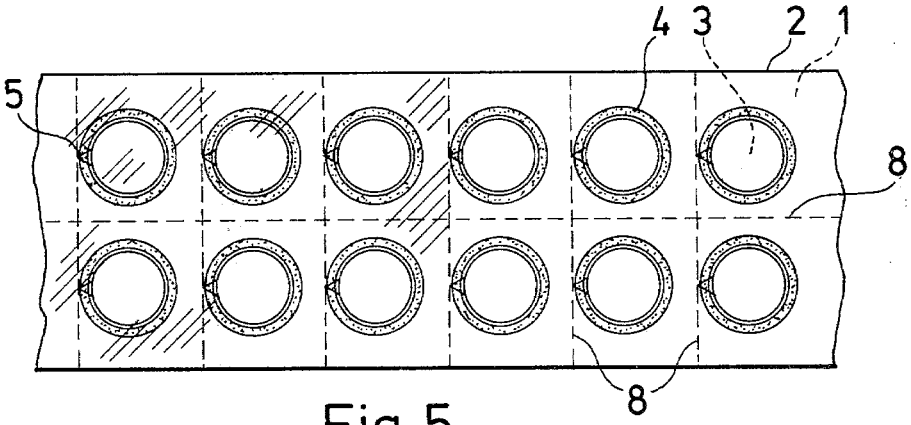
FIG. 5 depicts a plan view of a series of packages according to the invention, of the shape shown in FIG. 1.
Figure 6:
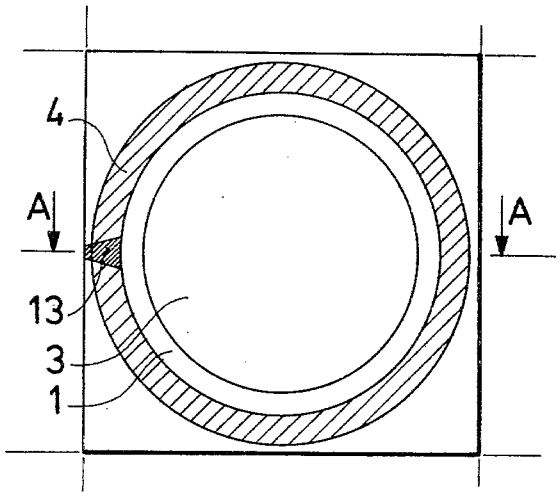
FIG. 6 depicts a plan view of a third package according to the invention.
Figure 7:
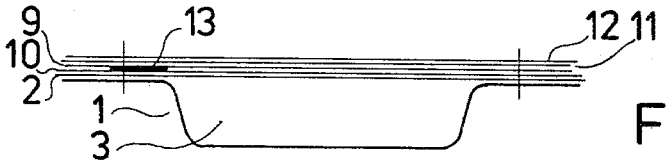
FIG. 7 depicts a schematic section of the package as seen from the side; section A—A of FIG. 6, FIG. 8 also depicts section A—A, but here the package is composed of the different film layers separately.
Figure 8:
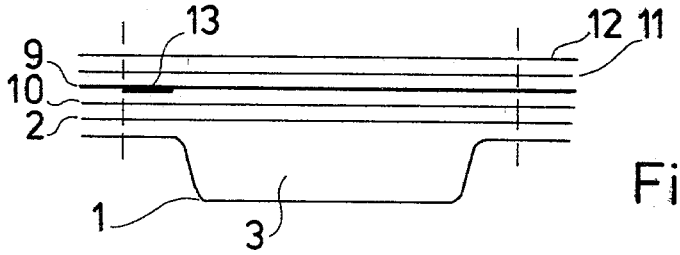

During the manufacture the packages according to the invention can advantageously be placed successively and side by side to form a series, for example on a sheet of plastic film or on a continuous band. FIG. 5 depicts such a combination. It consists of, for example, two plastic sheets or bands 1 and 2, with depressions 3, corresponding to the shape of the packages, having been formed in the lower one, the bottom part 1, and the upper part 2 constitutes the top part to be sealed. Individual packages can be detached from such a series at tearing points 8, which are, for example, thinnings or perforations made between the packages. The discharge conduits 5 according to the invention have been arranged to end at the said tearing lines and they can, furthermore, be marked in a suitable way, with an arrow pattern, for example, whereby the discharge point can clearly be seen and the package can be directed correctly.

When manufactured as a continuous band, the packages according to the invention can be manufactured automatically and economically using machines suitable for the purpose. In this case series of suitable size can be cut from the manufactured continuous band containing several rows of packages, and they can then be formed into separate packages ready for sale. These can, furthermore, be attached on, for example, a cardboard base provided with an appropriate text and prints and then covered with an additional, impermeable plastic film, which prevents the contents of the package from evaporating during storage before selling.

The shape of the individual packages can vary. A round shape is obviously the most advantageous, but other shapes can also be used.

The embodiments of the invention can vary within the patent claims.

What is claimed is:

1. A disposable portion package for a usable product, said usable product being in the form of a liquid, cream, paste, powder or the like, said package comprising two wall means sealed to one another along an overlapping section to thereby define a closed casing in which said product is disposed, one of said wall means comprising an outer stiffening layer means and an inner film layer, a seal weakening material disposed between a portion of said outer stiffening layer means and an overlapping portion of said inner film layer with the remaining portion of said outer stiffening layer means and said inner film layer being overlappingly joined to another, said seal weakening material being overlappingly disposed relative to a portion of said overlapping section of said two wall means, said inner film layer being constructed and arranged such that when external pressure is applied to the package by the user for obtaining access to the usable product, the part of the inner film layer juxtaposed said seal weakening material ruptures and the product exits said package through said rupture in said inner film layer and through a conduit formed between said stiffening layer means and said inner film layer at the portion where said seal weakening material is disposed.

2. A disposable portion package according to claim 1, wherein said outer stiffening layer means comprises an outer member layer and an intermediate member layer, said seal weakening material being disposed between a portion of said outer member layer and said intermediate member layer with the remaining portions of said outer member layer and said intermediate member layer being overlapping joined to one another, said intermediate member layer being overlappingly joined to said inner film layer, sid intermediate member layer and said inner film layer being constructed and arranged such that when said external pressure is applied to the package, the part of the intermediate member layer and the part of the inner film layer juxtaposed to said seal weakening material ruptures and the products exits through said rupture and through the conduit formed between said outer member layer and said intermediate member layer at the portion where said seal weakening material is disposed.

3. A disposable portion package according to claim 1, wherein said outer stiffening layer means comprises an outer member layer and an intermediate member layer, said seal weakening material being disposed between a portion of said intermediate member layer and said inner film layer with the remaining portions of said intermediate member layer and said inner film layer being overlappingly joined to one another, said outer member layer being overlappingly joined to said intermediate member layer, said inner film layer being constructed and arranged such that when said external pressure is applied to the package, the part of the inner film layer juxtaposed to said seal weakening material ruptures and the products exits through said rupture and through the conduit formed between said intermediate member layer and said inner film layer at the portion where said seal weakening material is disposed.

4. A disposable portion package according to claim 1, wherein said inner film layer is substantially thinner than the thickness of the other of said wall means.

5. A disposable portion package according to claim 4, wherein the thickness of said inner film layer is from 1/5 to 1/100 the thickness of said other wall means.

6. A disposable portion package according to claim 1, wherein said inner film layer and said intermediate layer member are together substantially thinner than the thickness of the other of said wall means.

7. A disposable portion package according to claim 6, wherein said inner film layer and said intermediate layer member are together 1/5 to 1/100 the thickness of said other wall means.

8. A disposable portion package according to claim 1, wherein the thickness of said inner film layer is from 1 to 35 μm and the thickness of the other of said wall means is 100 to 250 μm.

9. A disposable portion package according to claim 8, wherein the thickness of said inner film layer is from 5 to 20 μm and the thickness of the other of said wall means is 100 to 250 μm.

10. A disposable portion package according to claim 1, wherein the thickness of said inner film layer and said intermediate layer together is from 1 to 35 μm and the thickness of the other of said wall means is 100 to 250 μm.

11. A disposable portion package according to claim 1, wherein the thickness of said inner film layer and said intermediate layer together is from 5 to 20 μm and the thickness of the other of said wall means is 100 to 250 μm.

12. A disposable portion package according to claim 1, wherein said outer stiffening layer means comprises aluminum foil.

13. A disposable portion package according to claim 1, wherein said outer stiffening layer means comprises aluminum foil covered with a paper layer.

14. A disposable portion package according to claim 1, wherein said outer stiffening layer means comprises aluminum foil covered with a polyethylene layer.

15. A disposable portion package according to claim 1, wherein said stiffening layer means has applied thereto a primer laquer.

16. A disposable portion package according to claim 1, wherein said seal weakening means comprises a color marker substance.

* * * * *